United States Patent [19]

Eckhardt et al.

[11] 4,093,888

[45] June 6, 1978

[54] LIQUID-METAL PLASMA VALVE CONFIGURATIONS

[75] Inventors: Gisela Eckhardt; Wilfried O. Eckhardt, both of Malibu, Calif.

[73] Assignee: Hughes Aircraft Company, Culver City, Calif.

[21] Appl. No.: 692,173

[22] Filed: Jun. 2, 1976

[51] Int. Cl.[2] ..... H01J 13/00

[52] U.S. Cl. ..... 313/163; 313/34; 313/173

[58] Field of Search ..... 313/34, 163, 173

[56] References Cited

U.S. PATENT DOCUMENTS

| | | | |
|---|---|---|---|
| 3,475,636 | 10/1969 | Eckhardt | 313/173 X |
| 3,659,132 | 4/1972 | Eckhardt | 313/34 X |

*Primary Examiner*—Rudolph V. Rolinec
*Assistant Examiner*—Darwin R. Hostetter
*Attorney, Agent, or Firm*—Allen A. Dicke, Jr.; W. H. MacAllister

[57] ABSTRACT

Liquid-metal plasma valve has an anode, a condenser and a force-fed liquid-metal cathode. These bound the interelectrode space through which the plasma jet acts during conduction. The cathode directs the plasma jet to impinge on an inclined surface which acts as the anode. The inclined surface reflects the particles to the condenser when the anode is noncondensing, but when the functions of anode and condenser are combined, the inclined surface of the condensing anode traps the jet particles. When the anode is noncondensing, in some cases the condenser and anode are at the same potential and in other cases the condenser and cathode are at the same potential. Cathode, anode and condenser are shaped to minimize the transit time of jet particles from emission to condensation.

22 Claims, 11 Drawing Figures

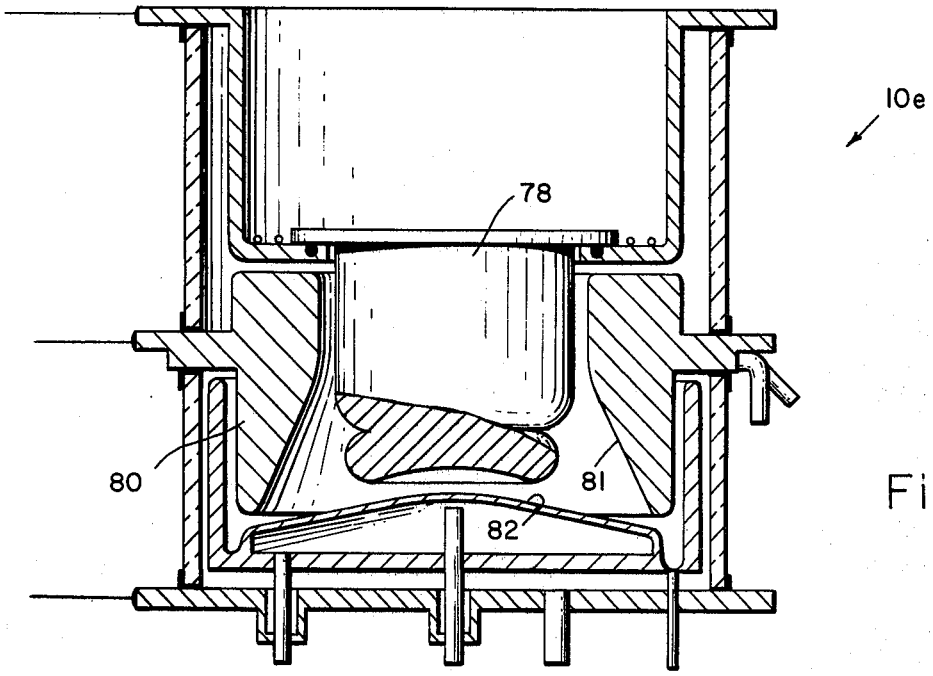
Fig. 7.
Fig. 10.
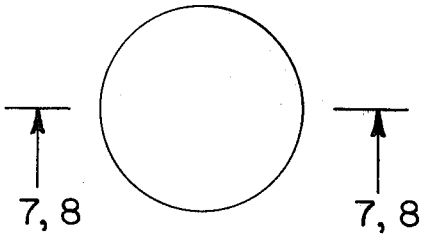
Fig. 11.
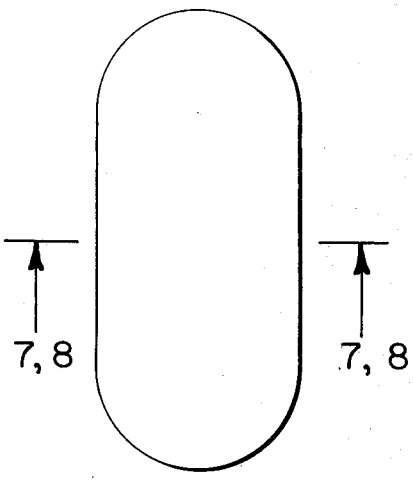

LIQUID-METAL PLASMA VALVE CONFIGURATIONS

BACKGROUND OF THE INVENTION

This invention is directed to electrode configurations in a liquid-metal plasma valve for minimization of offswitching time and maximization of offswitch current and voltage holdoff.

The broad field in which this invention resides is the liquid-metal cathode electrical conducting device field which includes mercury arc rectifiers and the like. The typical application of a liquid-metal cathode device for converter valve service, either for rectification or inversion, is characterized by long-term continuous operation at relatively high average current and relatively low peak current. Modern day voltage holdoff requirements go up to about 500 kilovolts. Under these conditions, it is generally preferable to employ a three-element valve such as is shown in W. O. Eckhardt U.S. Pat. No. 3,659,132 wherein the condenser is at cathode potential. This condenser reduces the background pressure of the liquid-metal vapor and collects neutral atoms and ions at offswitching to permit a rapid increase in holdoff voltage to a high value. In such valves, it is desirable to have the condenser at cathode potential because liquid-metal recirculation is necessary, and isolators for the recirculation line become difficult or impractical at high voltage holdoff levels.

DC switching applications have somewhat different requirements from the converter application. In any case the current rating determines the size of the jet of ionized liquid metal and hence the size of the electrodes while the positioning and shape of the cathode, anode and condenser control offswitching time.

SUMMARY OF THE INVENTION

In order to aid in the understanding of this invention, it can be stated in essentially summary form that it is directed to a two- or three-element liquid-metal plasma valve which is configured to have its jet impinge upon the anode surface at an acute angle to direct the jet toward the condenser in the case of a noncondensing anode, and to aid in sticking of the jet particles in the case of a condensing anode.

It is thus an object of this invention to provide a liquid-metal plasma valve which has its condenser at anode potential with a configuration which reduces the time interval required between the current zero and the appearance of an appreciable anode-to-cathode voltage. It is a further object to provide a liquid-metal plasma valve which is particularly suited for applications characterized by relatively low average current and very high peak current. It is yet another object to provide a two-element liquid-metal plasma valve which combines the functions of the anode and the condenser. It is yet another object to configure a three-element liquid-metal plasma valve with the condenser operating at anode potential to permit the condenser to be positioned very close to the anode.

It is another object of this invention to improve the geometry of the electrodes of a liquid-metal plasma valve, and particularly the geometry of the cathode, for functioning at very high ratings of current and voltage.

It is a further object to provide a liquid-metal plasma valve in which the anode has a face which is angular to the plasma jet to receive the plasma jet, and reflect the plasma jet toward condensing surfaces when the anode is non-condensing. It is another object to provide a divergent plasma jet to increase anode area under the jet and to position a convex or concave anode with an angular face to minimize transit to minimize offswitching time.

Other objects and advantages of this invention will become apparent from the study of the following portion of the specification, the claims, and the attached drawings.

BRIEF DESCRIPTION OF THE DRAWINGS

FIG. 7 is a longitudinal section through another liquid-metal plasma valve, with radially directed divergent jet, noncondensing anode, and with its condenser at anode potential.

FIG. 10 is a plan view of a valve similar to the valve of FIGS. 7 and 8 showing the section line on which the views of FIGS. 7 and 8 are taken.

FIG. 11 is a plan view of an elongated valve having opposed linear cathode grooves, and showing that the section therethrough is the same as FIGS. 7 and 8.

DESCRIPTION OF THE PREFERRED EMBODIMENTS

Figure 1:
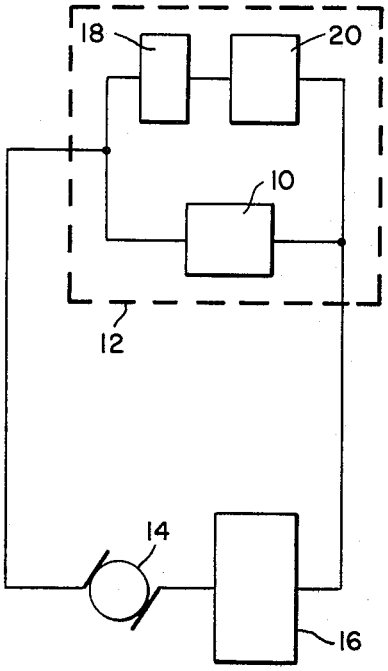
FIG. 1 is a schematic electrical diagram showing one use for the liquid-metal plasma valve of this invention.

The liquid-metal plasma valve 10 of this invention is indicated in longitudinal section in FIGS. 2, 4, 5, 6, 7 and 8. In FIG. 1, it is shown as part of a circuit breaker 12 which is in series with a source 14 and load 16. Circuit breaker 12 employs the liquid-metal plasma valve 10 as a conducting device, and a commutation circuit including series LC circuit 18 and closing switch 20.

Another preferred utility is the use of the valve as a converter, for ac to dc rectification or dc to ac inversion.

Figure 2:
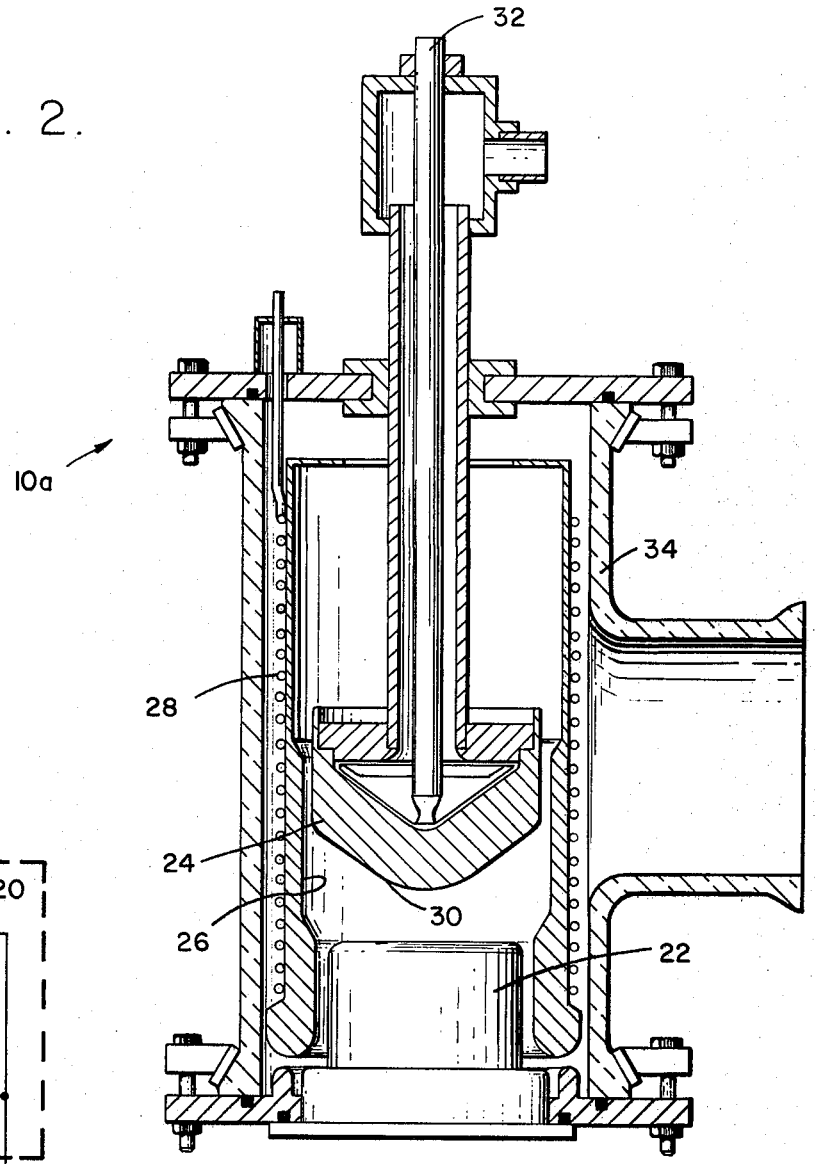
FIG. 2 is a longitudinal section through a preferred embodiment of the liquid-metal plasma valve with noncondensing anode and condenser at anode potential, showing portions thereof schematically.

The liquid-metal plasma valve 10*a* shown in longitudinal section in FIG. 2 is comprised of cathode 22, anode 24, and has condenser 26 of generally cylindrical tubular configuration surrounding at least the space between the anode and cathode. The condenser is positioned to be impacted by any plasma jet particles which flow directly from the cathode or are reflected off of the anode. Depending on the application, condenser 26 may be electrically connected to either the cathode or the anode, but in FIG. 2 it is shaped to be connected to the anode. Condenser 26 has cooling coil 28 secured to its outer surface, or otherwise in thermal conductivity with respect thereto, and is supplied with liquid nitrogen or other coolant to provide a condenser temperature between 77° K and slightly above the melting point of the liquid metal used, depending on thermal load.

Face 30 of anode 24 is convex and is virtually conical and is positioned and shaped so that divergent plasma jet flow from the cathode reflects onto the condenser. Anode 24 is cooled by coolant supplied to coolant inlet 32 which distributes the coolant to the inside of the nose of the anode. The anode is maintained at a sufficient temperature to prevent liquid-metal condensation on the anode (about 80° C for mercury), to minimize arcbacks. The thermal mass of the anode nose stabilizes and equalizes anode surface temperatures. The liquid-metal plasma valve 10*a* of FIG. 2 can be positioned in any orientation, and is preferably arranged so that liquid metal can be drained from the condenser, at least in those cases where longer duty cycles are required. Cathode 22 is described in more detail in FIG. 3. The glass Tee 34 serves both as the vacuum envelope and as the insulator between cathode 22 on the one hand, and anode 24 and condenser 26 on the other hand.

Figure 5:
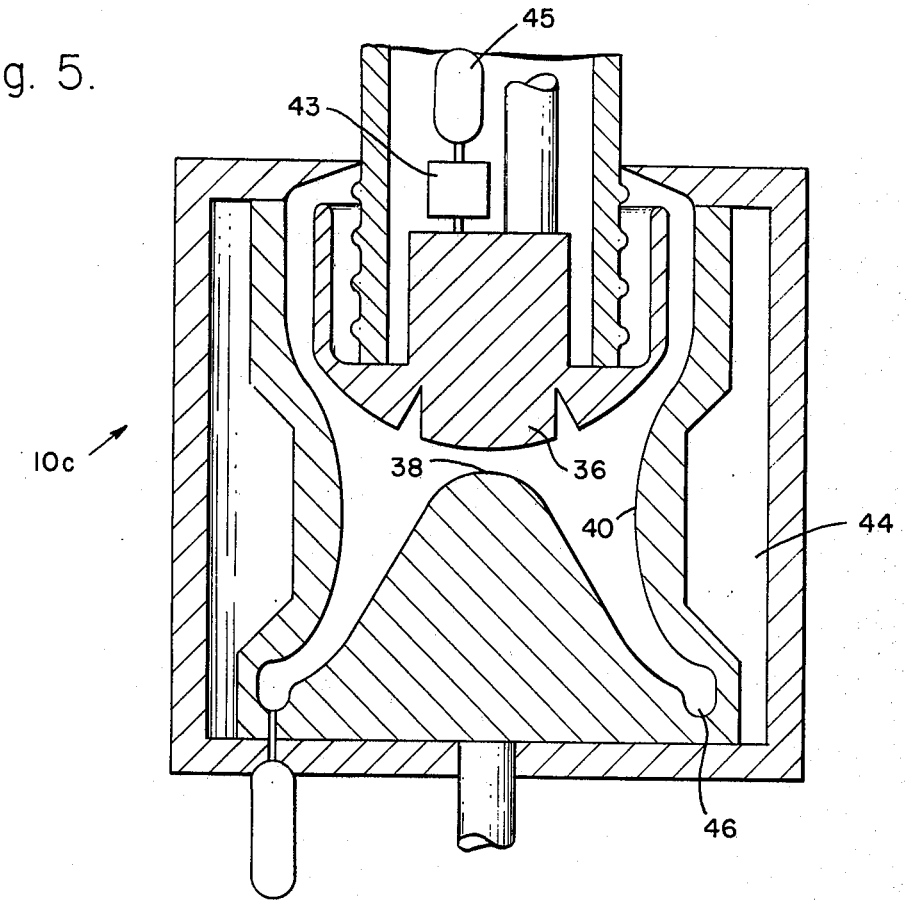
FIG. 5 is a longitudinal section through another preferred embodiment of the liquid metal-plasma valve having a condensing anode.
Figure 3:
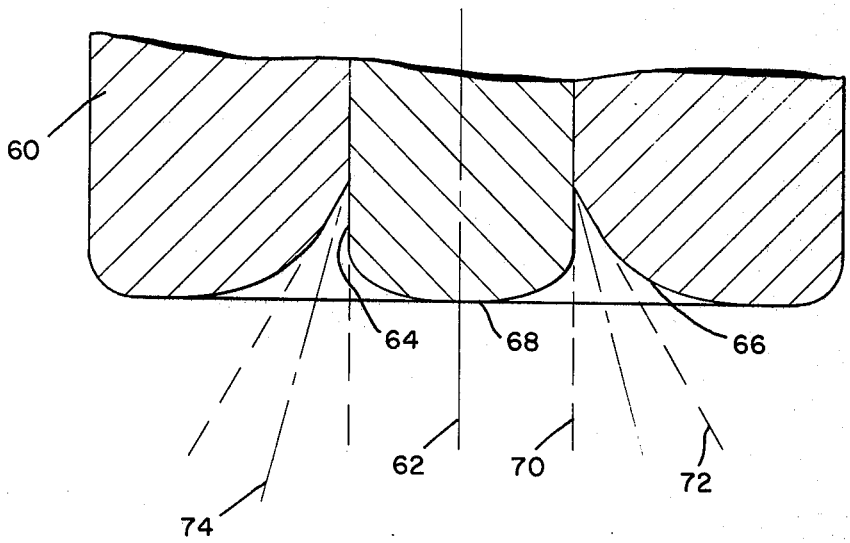
FIG. 3 is an enlarged detailed section through the axis of a cathode, such as those used in FIGS. 2, 4, and 5, showing the conical divergence of the pool-keeping structure.
Figure 4:
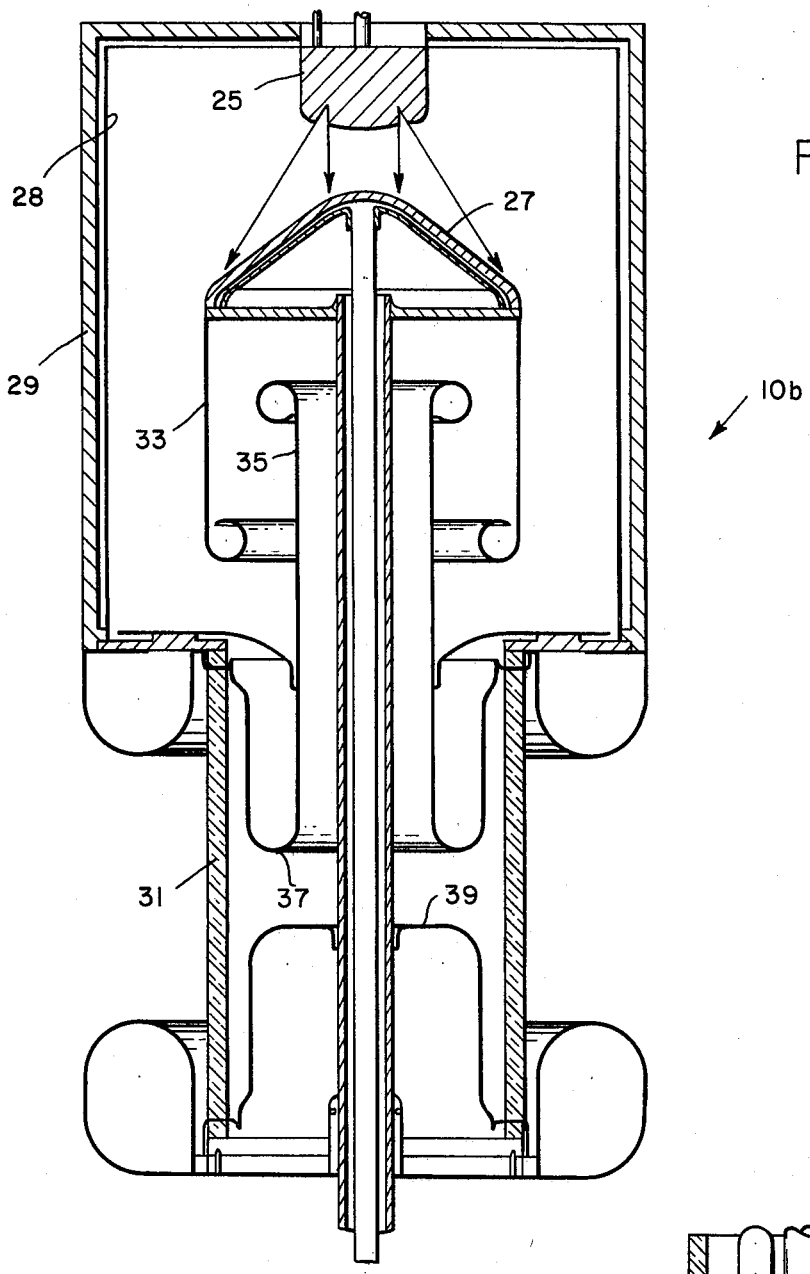
FIG. 4 is a longitudinal section through another preferred embodiment of a similar valve which has the condenser at cathode potential.

FIG. 3 shows cathode 60 which is the same as the cathodes 22, 25, and 36, respectively, seen in FIGS. 2, 4, and 5. Centerline 62 of cathode 60 is on the axial centerline of the liquid-metal plasma valve 10. Pool-keeping walls 64 and 66 are cylindrical and conical surfaces of revolution around axis 62, respectively. The pool-keeping walls extend into cathode 60 below face 68. Wall 66 is divergently conical in the downward direction of FIG. 3 while wall 64 is cylindrical. FIG. 5 shows how a liquid metal is fed to the juncture of these walls by a pump 43 from a reservoir 45. The amount of liquid metal retained by the walls at their juncture due to surface tension forces is made sufficiently small that it is gravity-independent. The material of the cathode is preferably a refractory metal, such as molybdenum and, after cleaning of the pool-keeping walls by arcing, liquid metal wets the walls and is retained by them. The preferred liquid metal is mercury.

Assuming that arcing has started, the condenser surface is kept sufficiently cool, never appreciably above the melting point of the liquid metal under the most severe thermal load, so that the background pressure in the interelectrode space is maintained as low as $10^{-4}$ Torr. Under these conditions, the plasma is expelled from the arc spot as a vapor jet. With the background pressure low in the interelectrode space, this jet is fairly well defined, is divergent generally in the direction of the pool-keeping walls, and is in the form defined by the dashed lines 70 and 72 in FIG. 3.

The pool-keeping walls define the plasma jet as being virtually constrained by extensions of the pool-keeping wall surfaces. The inner jet boundary is substantially defined by line 70 while the exterior jet boundary is substantially defined by line 72, which are both surfaces of revolution around axis 62. The bisector line between the walls is shown by bisector line 74, which lies between the pool-keeping walls. Bisector line 74 defines the center of the jet which is divergent as it moves downward along bisector line 74, and the bisector line also defines a divergent cone in the direction of plasma jet flow. This configuration of the pool-keeping walls provides divergent flow. Equilibration by energy exchange between the fast and slow particles in the plasma jet flow is substantially accomplished by proper design of the pool-keeping wall structure of the cathode downstream from the liquid-metal pool. This is discussed in more detail below. W. O. Eckhardt U.S. Pat. No. 3,475,636 discusses this kind of cathode structure in more detail, particularly with respect to maximization of the electron-to-atom emission ratio.

Liquid-metal plasma valve 10*b* of FIG. 4 is similar to the valve shown in FIG. 2, but its condenser is at cathode potential. It has cathode 25, which is described in more detail in FIG. 3. Cathode 25 faces anode 27 which has a conical face so that the particles in the plasma jet stream emitted from the cathode impinge at an angle on the anode surface. The anode is maintained at a sufficient temperature to prevent condensation of liquid metal on the anode surface, to minimize arcbacks upon polarity reversal. Condenser 28 is positioned around the anode and cathode to receive the particles and cause them to stick, condensing them on the surface; it also serves as part of the vacuum envelope. Thermal insulation 29 prevents the condensation of moisture on the outside of condenser 28.

Tube 31 is an insulator to electrically separate the anode and cathode. Shields 33 and 35 shape the potential lines between the anode and cathode and protect insulator 31 from a coating of the condensed liquid metal as well as from sputtered material. Shields 37 and 39 also provide this function. Liquid-metal plasma valve 10*b* is a commercial type of configuration designed as a converter valve, but which can also be employed as a switch.

FIG. 5 shows liquid-metal plasma valve 10*c* which has a cathode 36 of the same nature as the cathode shown in FIG. 3. It also has a condensing anode consisting of an inner cone 38 and a surrounding wall 40. The divergent plasma jet from the annular divergent pool-keeping walls in the cathode is directed to strike the anode-condenser surfaces about the inner and outer portions 38 and 40. Both surfaces are cooled so that the particles of the jet stick where they impinge. Both the inner portion 38 and outer portion 40 are formed of the same material and are cooled by suitable coolant such as liquid nitrogen in jacket 44. Gutter 46 is positioned to receive condensed liquid metal to drain it off and possibly recycle it, depending on the service. The shape of the plasma jet is determined by the pool-keeping walls of the cathode, and the positioning and shape of the condensing anode are such that the plasma jet stream impinges at such an angle that the impinging power density is sufficiently reduced to enable the plasma jet particles to stick where they impinge rather than reflect to another surface.

Figure 6:
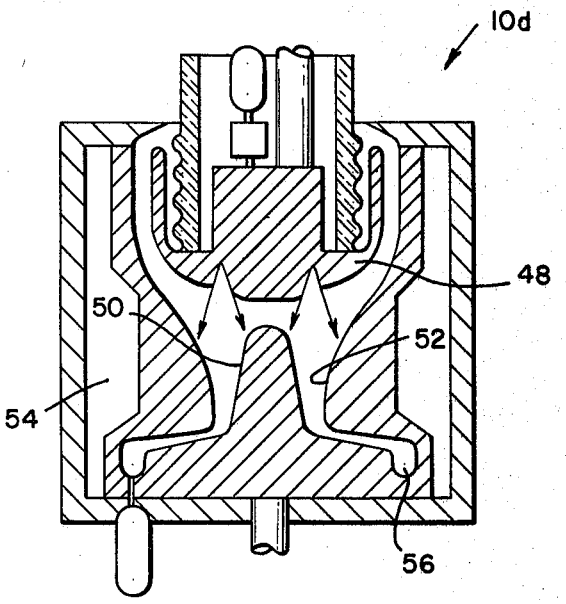
FIG. 6 is a longitudinal section through another valve having characteristics similar to the valve of FIG. 5 but with a cathode having a conical, rather than cylindrical, inner wall of the pool-keeping structure.

Liquid-metal plasma valve 10*d* of FIG. 6 is similar to valve 10*c* of FIG. 5, in that the anode-condenser structure is functionally and structurally combined. Cathode 48 is very similar to cathode 36 and cathode 60 (FIG. 3), but the bisector of the pool-keeping walls defines a cylindrical rather than divergently conical configuration. In order to provide angularly positioned surfaces on the condensing anode on which the plasma jet particles can stick, inner surface 50 and outer surface 52 are provided in the anode-condenser. They are both cooled by coolant in jacket 54. Gutter 56 collects the condensed liquid metal for recycling. Since the bisector of the plasma jet stream is not divergent, the structure which provides the inner surface 50 is of smaller size, and thus is more difficult to cool. Thus, for continuous duty operations a more divergent structure as in FIG. 5 is preferred to reduce local cooling problems. However, the angular positioning of the condensing anode surfaces with respect to the plasma jet flow distributes the current and hence heating load over a larger area so that the formation of local hot spots is reduced as compared to an anode surface which is perpendicular to the flow of the plasma jet.

Liquid-metal plasma valve 10*e* in FIG. 7 is similar to the one in FIGS. 2, 4, and 5 in that cathode 78 provides divergent flow of the plasma jet and directs it toward anode 80. Anode 80 has its conical face 81, on which the plasma jet strikes, positioned and configured so that reflected plasma jet particles are directed onto condenser surface 82. In some cases the condenser is electrically connected to the cathode, for example, for very-high-current, medium-voltage converter service. In other cases it is electrically coupled to the anode, for example, for very-high-current switching service. Cooling is as previously described.

Figure 8:
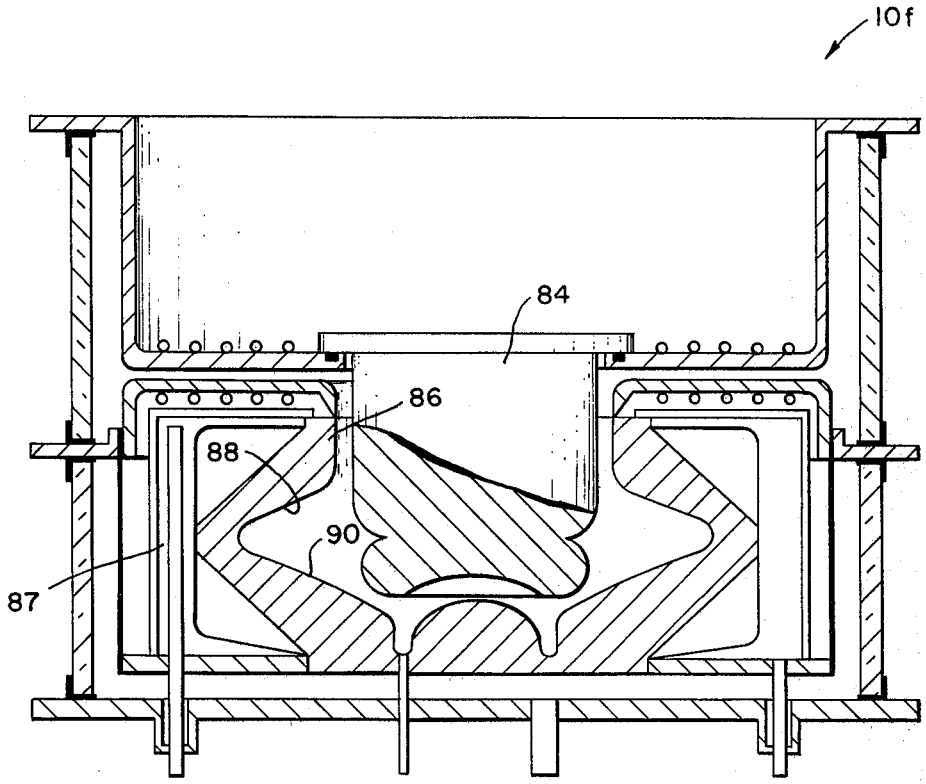
FIG. 8 is an axial section through a liquid-metal plasma valve having a cathode similar to the valve of FIG. 7, and with a condensing anode.

Liquid-metal plasma valve 10*f* of FIG. 8 has cathode 84 which directs a divergent plasma jet toward a structure 86 which serves as a combined anode and condenser. The condensing anode is surrounded by cooling mantle 87. The interior surfaces of the condensing-anode structure include surfaces 88 and 90 which face each other, are generally conical and which are in the path of the plasma jet. They are positioned and configured so that particles angularly impinge on the surface of the combined structure and stick thereto so they are not reflected back to the cathode.

Figure 9:
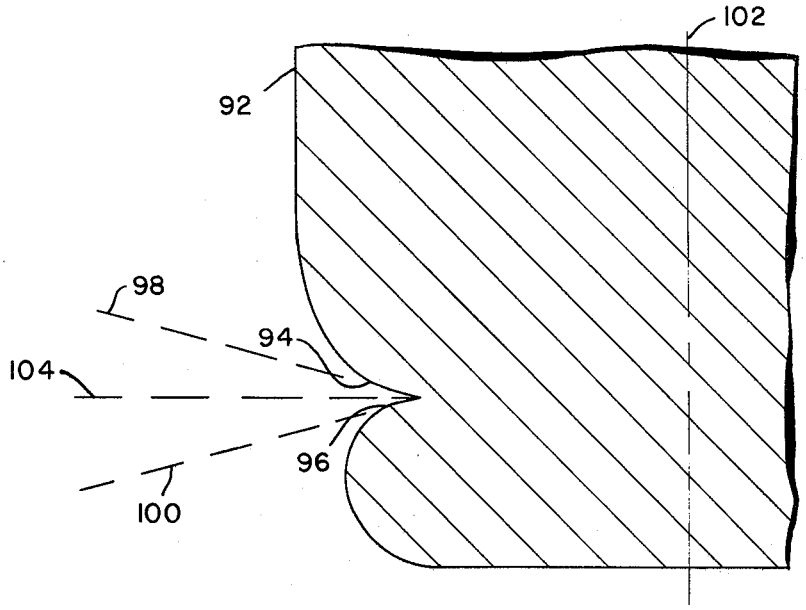
FIG. 9 is a longitudinal section with parts broken away through the cathode of FIGS. 7 and 8.

Cathode 78 and 84 of FIGS. 7 and 8 are illustrated in more detail by cathode 92 in FIG. 9. Cathode 92 has pool-keeping walls 94 and 96 which are divergent from each other. Extensions of these walls are represented by lines 98 and 100 which are conical surfaces about axis 102 of the cathode. Lines 98 and 100 substantially define the edges of the plasma jet stream. The bisector line 104 lies equally between the pool-keeping surfaces and in the special case illustrated in FIG. 9 is the surface of a cone having a 180 total included angle. Thus, the cathode of FIG. 9 is the same as the cathode of FIG. 3, but for the special case where the conical bisector 74 is spread out and lies flat in a plane, which is the limiting case for the cone.

FIG. 10 illustrates the configuration of the valves 10*e* and 10*f* on FIGS. 7 and 8 as being circular. In FIG. 10, the section is through a diameter of a circular structure. Should higher currents be required the cathode groove can be lengthened either by increasing the diameter or by elongating the valve in one of its directions. FIG. 11 is a top plan view of an elongated valve, and the section therethrough can appear the same as the sections in FIGS. 7 and 8. Valves having the configuration of FIG. 11 are particularly useful for higher currents.

In all of the valves, as far as the temperatures are concerned, of course the condensers are cold, as described above. Sputter shields are hot to prevent condensation of liquid metal, and the insulators are also hot for the same reason. The anode surfaces can either be hot or cold. When they are cold, they act as condenser surfaces, but when they are hot, they prevent condensation of liquid metal thereon in order to reduce the chance of arcback upon reversal of voltage. In the configurations of the valve parts shown in FIGS. 2, 5, 6, 7, and 8 there is a considerably shorter time interval required between current zero and the appearance of an appreciable voltage between the anode and cathode than in a valve designed for operation of the condenser at cathode potential as in W. O. Eckhardt U.S. Pat. No. 3,659,132. The configurations shown in FIGS. 2, 5, and 6 are typically smaller, but they also have a lower average current-carrying capability than the configurations of FIGS. 7 and 8.

The capability of a switching device of this nature to withstand high voltage after current conduction depends upon its ability to: (1) deionize its discharge chamber within the shortest possible time, (2) restore high vacuum by suitable pumping within the shortest possible time, in order to avoid Paschen breakdown, and (3) subsequently withstand the full voltage without vacuum breakdown. Reduction in time for deionization and achievement of satisfactory vacuum requires a minimization of the transit time. The ions and neutral particles which are emitted by the cathode are scattered by the anode, if noncondensing, and are finally condensed on the condensing walls. Minimization of transit time is achieved by keeping the electrodes as small as possible, positioning them as closely together as is possible, and properly directing the plasma jet. However, the requirement that the switching device subsequently withstand the full voltage without vacuum breakdown acts as a constraint upon the minimization of distances between the electrodes because there exist empirical values for the maximum electric field strength which should not be exceeded for surfaces which have been previously cleaned by arcing, in order to assure high vacuum holdoff. There is also a constraint on the minimization of electrode size, because there are upper bounds for the linear current density which can exist at the cathode pool perimeter and for the current density that may impinge on the anode without danger of anode spot formation and for the particle and radiation flux density from the discharge plasma that may impinge on the condensing surface without impairing its condensation efficiency.

W. O. Eckhardt U.S. Pat. No. 3,475,636 at FIGS. 8 and 9 and W. O. Eckhardt U.S. Pat. No. 3,659,132 at FIGS. 1, 3, and 4 disclose an annular liquid-metal pool. The pool is defined by pool-keeping walls. In this prior art, the inner wall is conical and converges in the direction of the plasma jet. The outer wall is conical and diverges in the direction of flow of the plasma jet. Both walls are conical about the axis of the cathode. The bisector between the walls is parallel to the axis and, as the bisector moves around the annular cathode pool, the bisector defines a cylinder. Furthermore, the walls diverge at least about 45°.

Referring to FIGS. 3, 4, and 5 it is seen that the inner pool-keeping walls 64 of the annular cathode pool are substantially cylindrical with respect to the axis, and the outer pool-keeping wall 66 is conical and divergent with respect to the cathode axis. The bisector between these two walls defines a divergent cone in the direction of jet flow. The bisector defines the central path of plasma jet flow and can be considered a "surface of symmetry" with about half of the flow passing outside and about half of the flow passing inside that surface. The surface of symmetry is a divergent cone in the direction of jet flow.

Thus, the cathode configuration of this invention includes the divergent surface of symmetry for the annular gap containing the liquid-metal pool. This configuration keeps the vapor flux density low in the central region by directing the vapor jet from the cathode toward the outer portion of the anode.

The angle between the pool-keeping walls is considerably narrower than previously and is approximately 30°. Furthermore, the depth of the pool-keeping walls below the front surface of the cathode is deeper than in previous structures. The depth is chosen to contain most of the collision regions for charge-exchange and elastic collisions beyond the liquid-metal pool surface during tube operation under normal conditions. This construction serves to greatly improve the velocity equilibration of fast and slow, neutral and ion flux components which are known to be generated at the mercury surface (see Gisela Eckhardt: *Journal of Applied Physics,* Volume 44, page 1146, 1973). The equilibration is accomplished by increasing the number of collisions in the vapor jet close to the liquid-metal pool surface by increasing the density over the extended distance within the gap between the walls. The deeper and narrower gap defined by the walls improves velocity equilibration. The improved velocity equilibration reduces the overall transit time necessary to reach the condensing wall for the majority of all particles. Thus, restoration of high vacuum in a switching device can be accomplished within a shorter time than was possible in the old structure.

As discussed above, there is a current limit per unit length of the annular pool. In order to increase the total current rating, the perimeter of the cathode pool is increased. For an increased voltage rating of a valve as shown in FIG. 4, both the distance between the anode and the cathode and the diameter of the cylindrical condenser are increased. Therefore, in a scaled-up version for higher current and voltage, the transit times for ions and neutrals from the cathode to the condenser would normally be increased. However, the improved cathode configuration achieves substantial decreases in overall transit times of ions and neutrals.

The achievement of total (or near total) velocity equilibration between the fast ions (emitted by the cathode spots) with the slow neutrals (evaporated from the liquid-metal pool) requires a certain minimum particle density over some minimum distance from the pool surface. Due to the divergence of the particle stream it is not possible to make a general statement as to which density and which distance are required to achieve such velocity equilibration, because this divergence depends on (a) the electron-to-atom emission ratio which also determines the ratio of slow-to-fast particles, (b) the shape of the pool-keeping groove (its depth and the included angle of its walls), and (c) the linear current density. The shape of the pool-keeping groove therefore must be adapted to the particular application to obtain velocity equilibration. However, an example can be given for which velocity equilibration is obtained in the case of mercury as the liquid metal: discharge current, 1800A; electron-to-atom emission ratio, 50; linear current density, 70A/cm; depth of groove, above Hg surface, 0.4 cm; included angle of pool-keeping groove, 30°. If, for instance, this angle was increased to 60°, total velocity equilibration would not be achieved.

With respect to the equilibration of fast and slow, neutral and ion flux components of the jet, research on mercury vacuum arcs has shown that two groups of particles originate at the mercury cathode (see Gisela Eckhardt: *Journal of Applied Physics,* Volume 44, page 1146, 1973, cited above). One group has thermal rms velocities of (2–10) × 10 meter/second and originates at the spot-free mercury surface, while the other group consists of particles which are ejected from the cathode spots at super-thermal velocities of 7.5 × 10 meter/-second. If the liquid-metal plasma valve is operated with electron-to-atom emission ratios between 50 and 100 (or ratios of fast-to-slow particle fluxes between 1:3 and 1:1), if there is no velocity equilibration, the thermal velocity determines the time it takes to restore high vacuum. However, when there is complete velocity equilibration between fast and slow particles, the cathode-to-anode transit time will be reduced by a factor of 15 to 25 for a thermal rms velocity of 2 × 10 meter/-second and a factor of 3 to 5 for a thermal rms velocity of 10 meter/second. The precise thermal rms velocity is not known and is only known to lie within the above limits.

In order to avoid arcbacks in the valve the generation of a spray of micron-sized liquid-metal droplets by the cathode spots has to be prevented. Unanchored spots invariably produce large amounts of large droplets. Therefore, the maximum current per unit length of liquid-metal pool perimeter (linear current density) has to be limited such that the cathode spots remain anchored on the liquid-metal film which forms at the intersections between the liquid-metal pool and the refractory metal pool-keeping structure. The anchoring capability will be ultimately limited by the diameter of the cathode spots. But before they form a dense array, one may reach a limit because of insufficient dissipation of the heat generated by the spots at the walls of the pool-keeping structure. These walls may then become so hot that only an intermittent liquid-metal film or none at all can form at the intersection of pool-keeping walls and liquid-metal pool, forcing some or all spots to run on the pool proper. The limit, therefore, depends largely on design details, pertaining to the cathode cooling system. For instance, beginning disengagement of the spots has been observed by the inventors in a system which was not yet considered optimally cooled at a linear current density of about 700A/cm with mercury, but values given in the literature are considerably lower, about 25 to 50A/cm [L. Tonks, *Physics,* 6, 294 (1935) and Yu. D. Khromoi, R. G. Antokhin, *Sov. Phys.-Tech. Phys.* 12, 954 (1968)].

This invention having been described in its preferred embodiment, it is clear that it is susceptible to numerous modifications and embodiments within the ability of those skilled in the art and without the exercise of the inventive facility. Accordingly, the scope of this invention is defined by the scope of the following claims.

What is claimed is:

1. A liquid-metal plasma valve comprising:

an anode, a cathode and a condenser, an axis through said plasma valve, said anode facing said cathode to define an interelectrode space therebetween, said axis extending between said anode and said cathode through said interelectrode space, said condenser surrounding at least a portion of the interelectrode space;

said cathode having inner and outer pool-keeping walls defining a groove therebetween for containing a liquid-metal pool, said outer wall being divergent with respect to said inner wall in the direction out of said groove and the bisector between said walls being divergent away from said axis in the direction along said axis from said cathode toward said anode.

2. The liquid-metal plasma valve of claim 1 wherein said valve has an axis extending from said cathode toward said anode and said walls are substantially surfaces of revolution about said axis.

3. The valve of claim 1 wherein said inner pool-keeping wall is substantially a cylindrical wall of revolution about said axis.

4. The liquid-metal plasma valve of claim 3 wherein said outer wall is a conical wall of revolution about said axis, said conical outer wall being divergent in the direction from said cathode toward said anode.

5. A liquid-metal plasma valve comprising an anode, a cathode and a condenser;

said cathode having recessed pool-keeping walls for defining a liquid-metal pool, said condenser being coolable to maintain the partial pressure of condensable liquid-metal vapor in the interelectrode space at least as low as 10 Torr, the improvement comprising;

said condenser and said anode being electrically connected and said condenser being electrically insulated from said cathode so that said condenser is at anode potential.

6. The liquid-metal plasma valve of claim 5 wherein said anode is convex dome-shaped, and said anode dome faces said cathode.

7. The liquid-metal plasma valve of claim 5 wherein said anode and said condenser are structurally and functionally combined and are both at condenser temperature.

8. The liquid-plasma valve of claim 6 wherein said valve has an axis and said anode surface is substantially a surface of revolution about said axis and said condenser is a surface which is substantially a surface of revolution about said axis.

9. The liquid-metal plasma valve of claim 5 wherein said valve has an axis and said walls are surfaces of revolution about said axis, at least one of said pool-keeping walls being substantially conical about said axis, so that a liquid-metal vapor jet is ejected from the liquid metal on said pool-keeping walls, said walls being open towards said anode so at least part of the vapor jet directly impinges on said anode.

10. The liquid-metal plasma valve of claim 5 wherein said anode has a convex surface positioned to receive at least part of the plasma jet issuing from between said pool-keeping walls, said convex surface of said anode being directed and said condenser being positioned so that substantially all plasma jet particles in the plasma jet impinging on said anode surface and reflecting therefrom are directed toward said condenser.

11. The liquid-metal plasma valve of claim 9 wherein said anode has a convex surface positioned to receive at least part of the plasma jet issuing from between said pool-keeping walls, said convex surface of said anode being directed and said condenser being positioned so that substantially all plasma jet particles in the plasma jet impinging on said anode surface and reflecting therefrom are directed toward said condenser.

12. The liquid-metal plasma valve of claim 5 wherein said anode has a substantially conical surface positioned to receive at least part of the plasma jet issuing from between said pool-keeping walls.

13. The liquid-metal plasma valve of claim 9 wherein said anode has a substantially conical surface positioned to receive at least part of the plasma jet issuing from between said pool-keeping walls.

14. The liquid-metal plasma valve of claim 9 wherein said anode is positioned in front of the opening of said pool-keeping walls so that substantially all of the plasma jet impinges on said anode.

15. The liquid-metal plasma valve of claim 9 wherein said anode and said condenser are positioned in front of the opening of said pool-keeping walls so that the liquid-metal vapor jet ejected from a pool at the juncture of said walls impinges on a combined anode-condenser structure.

16. A liquid-metal plasma valve comprising:

an anode and a cathode spaced therefrom to define an interelectrode space;

a condenser to condense particles from said interelectrode space;

said cathode having first and second pool-keeping walls defining a groove therebetween for containing a liquid-metal pool, said first wall being divergent with respect to said second wall in a direction out of said groove and the bisector between said walls being divergent in a direction away from said cathode so that a plasma jet issuing from said groove has minimum ion path crossing to minimize high density jet portions;

said anode facing said cathode and having an angular surface, said angular surface being positioned to receive at least some of the plasma jet issuing from said groove, said angular surface of said anode being directed and said condenser being positioned so that plasma jet particles reflecting from said anode are directed toward said condenser.

17. The liquid-metal plasma valve of claim 16 wherein said condenser and said anode are electrically connected together so that said condenser is at anode potential.

18. A liquid-metal plasma valve comprising an anode, a cathode, and a condenser;

means comprising first and second pool-keeping walls on said cathode for defining a groove therebetween for carrying a liquid-metal pool therein and said walls being dimensioned so that said means is for causing substantial equilibration between fast and slow particles issuing as a jet stream from the pool during arcing by defining a collision region for charge-exchange and elastic collisions between fast and slow particles in the jet stream between said walls so that upon termination of arcing the interelectrode space is cleared of liquid-metal jet stream particles sooner than if a sufficient number of particles moving at thermal velocities were present to cause Paschen breakdown after the fast particles are removed.

19. A liquid-metal plasma valve comprising:

a cathode having pool-keeping walls defining a groove therebetween for containing a liquid-metal pool, said walls diverging from each other in a direction out of said groove;

an anode facing said cathode, said anode having a face toward said cathode, said anode face being positioned so that at least some of the plasma jet issuing from said groove strikes said anode and said anode face is directed so that the plasma jet impinges thereon at an acute angle;

condenser means for condensing particles from said plasma jet; and a housing surrounding said anode, said cathode and said condenser for permitting maintenance of a subatmospheric pressure in the interelectrode space.

20. The liquid-metal plasma valve of claim 19 wherein said condensing means is thermally and structurally combined with said anode so as to form a condensing anode for conducting the current and condensing the plasma jet.

21. A liquid-metal plasma valve comprising:

an anode electrode and a cathode electrode spaced therefrom, and a condenser surrounding the interelectrode space, said anode electrode facing said cathode electrode;

said cathode having inner and outer pool-keeping walls defining a groove for containing a liquid-metal pool, said anode being acutely angularly positioned with respect to the bisector between said walls so that the plasma jet issuing from the liquid-metal pool impinges on said anode at an acute angle.

22. The method of reducing the offswitching time in a liquid-metal plasma valve which has an anode, a cathode, and a condenser comprising the step of:

forming a groove in the cathode between pool-keeping walls;

causing an arc to run in the low pressure, high electron-to-atom ratio mode on liquid metal on the pool-keeping walls adjacent the bottom of the groove;

exchanging energy between fast and slow particles to cause appreciable equilibration in the vapor jet generated by cathode spots on the liquid-metal pool on said walls adjacent the bottom of the groove toward the anode; and terminating arcing and vapor jet generation at the liquid-metal pool, and clearing the interelectrode space of jet particles earlier than if a sufficient number of particles moving at thermal velocity were present to cause Paschen breakdown after the fast particles are removed.

* * * * *

UNITED STATES PATENT AND TRADEMARK OFFICE

CERTIFICATE OF CORRECTION

PATENT NO. : 4,093,888

DATED : June 6, 1978

INVENTOR(S) : Gisela Eckhardt;Wilfried O. Eckhardt

It is certified that error appears in the above-identified patent and that said Letters Patent are hereby corrected as shown below:

Column 7, line 66, delete "(2-10) x 10" and
insert --(2-10) x $10^2$--

Column 8, line 1, delete "7.5 x 10" and
insert --7.5 x $10^3$--

Column 8, line 10, delete "2 x 10" and
insert --2 x $10^2$--

Column 8, line 12, delete "of 10" and
insert --of 10 x $10^2$--

Column 9, line 16, delete "10 Torr" and
insert --$10^{-4}$Torr--

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*